United States Patent [19]

Moorley

[11] 4,041,998

[45] Aug. 16, 1977

[54] END-JOINTING OF TIMBER

[75] Inventor: George Moorley, Leicester, England

[73] Assignee: Wadkin Limited of Green Lane Works, England

[21] Appl. No.: 667,213

[22] Filed: Mar. 15, 1976

[30] Foreign Application Priority Data

Mar. 22, 1975 United Kingdom ..... 12071/75

[51] Int. Cl.[2] ..... B27G 11/00; B27F 1/08

[52] U.S. Cl. ..... 144/315 R; 144/3 R; 144/91; 144/218; 144/231; 144/309 L; 144/314 B; 144/322; 156/304; 156/510

[58] Field of Search ..... 156/304, 510; 144/1 R, 144/2 R, 36, 39, 90 R, 90 A, 91, 134, 309 R, 309 L, 313, 314 R, 314 B, 315 R, 326 R, 218, 231, 236, 3 R, 321, 322

[56] References Cited

U.S. PATENT DOCUMENTS

| | | | |
|---|---|---|---|
| 3,602,275 | 8/1971 | Nissen | 144/313 X |
| 3,844,320 | 10/1974 | Dimter | 144/315 X |
| 3,927,705 | 12/1975 | Cromeens et al. | 144/3 R X |

*Primary Examiner*—Othell M. Simpson
*Assistant Examiner*—W. D. Bray
*Attorney, Agent, or Firm*—Larson, Taylor and Hinds

[57] ABSTRACT

A method of joining pieces of timber which comprises cutting arcuate grooves in the ends of two pieces of timber to be joined, adjacent grooves being separated by arcuate fingers, and adhering together the pieces of timber with the fingers of each piece being received in the grooves of the other piece. Also apparatus for carrying out the above method is disclosed.

8 Claims, 9 Drawing Figures

END-JOINTING OF TIMBER

FIELD OF THE INVENTION

The invention relates to a method and apparatus for forming end joints in timber, and to timber so joined.

PRIOR ART

It has been proposed to join timber end-to-end by means of finger jointing wherein a number of fingers on one piece of timber engage in recesses between corresponding fingers on another piece of timber. Such a joint is not always suitable for load-bearing members but is acceptable for joinery timber in which the strength of the joint is not so important. The fingers that have previously been produced have been formed by moving each piece of timber past the cutter edges of rotating cutters (or moving the cutters past the timber) so as to cut straight grooves in the timber and leave straight fingers between the grooves. Such a joint had had the disadvantage of a greater weakness in the plane of the fingers than in other planes, and has been expensive to produce, involving the movement of timber over an excessively long work path.

OBJECTS OF THE INVENTION

It is an object of the invention to provide a method of joining timber which overcomes the drawbacks of conventional finger jointing methods.

It is also an object of the invention to provide a method of jointing that is rapid and economical in operation, involving the minimum movement of timber.

It is also an object of the invention to provide apparatus for carrying out such a jointing method.

These and other objects are achieved by a method of joining pieces of timber which comprises cutting arcuate grooves in the ends of two pieces of timber to be joined, adjacent grooves being separated by arcuate fingers, and adhering together the pieces of timber with the fingers of each piece being received in the grooves of the other piece. The invention also provides timber joined by the above method.

The method of joining can be carried out particularly rapidly and accurately on apparatus using a rotary cutter which is generally disc-like, with cutter teeth on opposite faces thereof for simultaneously cutting the grooves in the ends of two pieces of timber to be joined according to the invention, the cutter teeth on each face being at radial locations corresponding to spaces between adjacent cutter teeth on the other face. Such a cutter preferably has means for re-grinding the cutter teeth without varying their radial location on the cutter, or for re-setting the cutter teeth radially after re-grinding. The cutter also preferably has saw teeth around the edge thereof and extending axially to either side of the cutter teeth, so that by moving the rotating cutter transversely across the ends of the two pieces of timber the ends of both pieces can be squared. This transverse movement of the cutter leaves the cutter teeth in a position, relative to the timber, to cut the annular grooves in the ends thereof merely by effecting relative movement between the timber and the cutter. Thus in a preferred form the method of this invention comprises the following successive steps:

1. Positioning two pieces of timber to be joined in end-to-end relationship;
2. Moving the rotary cutter transversely across the timber so that the saw-teeth square the ends;

3. Effecting relative movement between each piece of timber and the rotary cutter so as to bring the facing ends of the timber into contact with the cutter teeth on the opposite faces of the cutter and cut arcuate grooves in the timber;
4. Removing the cutter transversely;
5. Applying adhesive to the grooved ends of timber and adhering the said ends together with the fingers of each piece received in the grooves of the other piece.

The above method is advantageously carried out automatically on apparatus which comprises means for moving the timber in a direction parallel to the axis of the rotary cutter; means for clamping the timber in end-to-end relationship in predetermined positions relative to the rotary cutter; means for moving the rotary cutter transversely across the timber so that saw teeth on the cutter square the ends of the timber; means for effecting relative movement between the timber and the rotary cutter parallel to the axis of the rotary cutter so as effectively to bring the timber into contact with the cutter teeth and cut arcuate grooves therein; means for removing the rotary cutter from between the squared and grooved ends of timber; means for applying adhesive to one or both of the squared and grooved ends of timber; and means for urging the ends together so that the arcuate fingers on each piece are received in grooves in the other piece. Preferably the initial positioning of the pieces of timber in end-to-end relationship is effected by advancing the pieces of timber serially in the same direction and clamping the leading piece in position when its trailing edge is just within the cutting path of the peripheral saw teeth, and clamping the following piece in position when its leading edge is just within the cutting path of the peripheral saw teeth.

The positioning of the timber can be achieved by means of sensors, preferably photoelectric sensors.

The rotary cutter is preferably mounted on a swing arm so that it can swing transversely across the timber. The rotary cutter may if desired be secured against axial movement, in which case the relative movement between the ends of the timber and the rotary cutter is achieved by means moving the pieces of timber in opposited directions towards and against the cutter teeth on the opposite faces of the cutter. Preferably, however, the relative movement is achieved by clamping one piece of timber, advantageously the leading piece, to the table, clamping the other piece to another table and moving the said other table for a predetermined distance parallel to the axis of the rotary cutter and in a direction towards the cutter, and moving the rotary cutter for half that distance in the same direction. This latter procedure is preferred because when a number of relatively short pieces of timber are joined together to form a single continuous piece, the continuous piece can be clamped while the shorter pieces, which are easier to control, are moved.

The cutter teeth are preferably tapered and may be formed from a number of discs clamped together to form a single unit, each disc having a tapered periphery, with a single tooth form cut across all discs. Alternatively instead of discs the teeth may be formed by cutting a single tooth form across a continuous screw profile. If desired such a cutter unit could be mounted on a screw-thread of the same hand and pitch as the screw profile, so that rotation of the cutter unit does not alter the effective radial disposition of the teeth. Alternatively means could be provided for re-setting the cutter unit after each grinding operation.

Preferably the adjacent teeth on each cutter unit are spaced apart twice the distance of the intended spacing of the grooves to be cut. In such a case the cutter units are used in pairs, with the teeth of each cutter unit radially offset from the teeth of the other in the pair so that each cutter unit cuts alternate ones of an equally spaced array of arcuate grooves. The radial location of the cutter units is such that the grooves cut in one piece of timber by the complementary teeth of one pair of cutter units lie mid-way between the grooves cut in the other piece of timber by the complementary teeth of the other pair of cutter units on the other side of the rotary cutter.

The invention is illustrated by the drawings of which:

Figure 1:
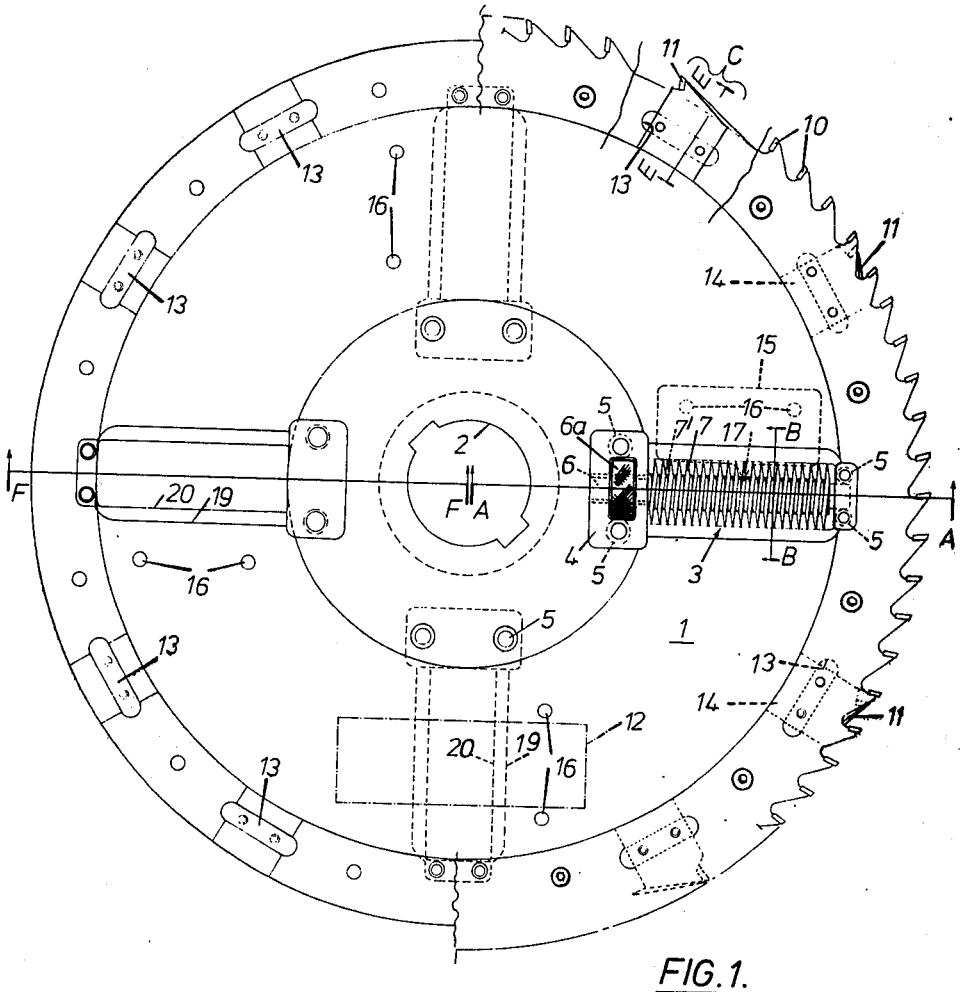
FIG. 1 is a side elevation of a rotary cutter according to the invention one half with and one half without the saw and cutter blades in position.
Figure 2:
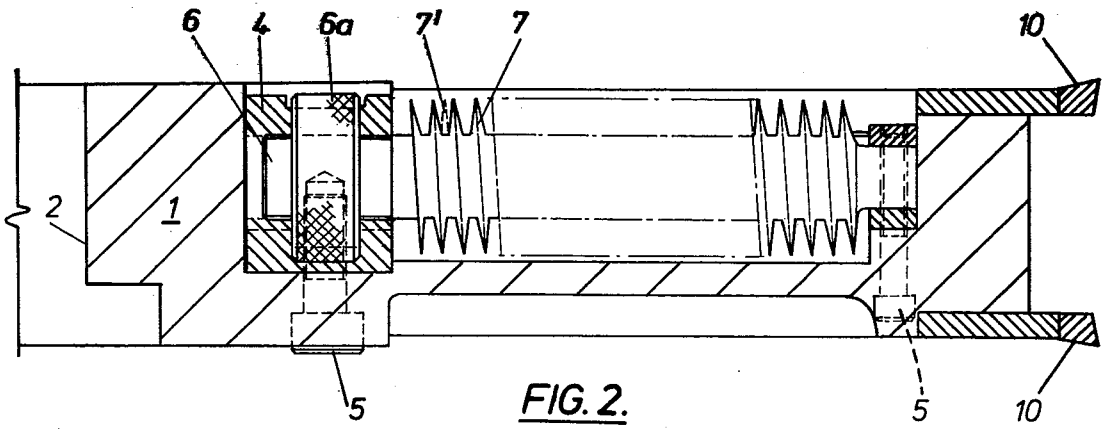
FIG. 2 is a section through the rotary cutter of FIG. 1, taken along the line A—A
Figure 3:
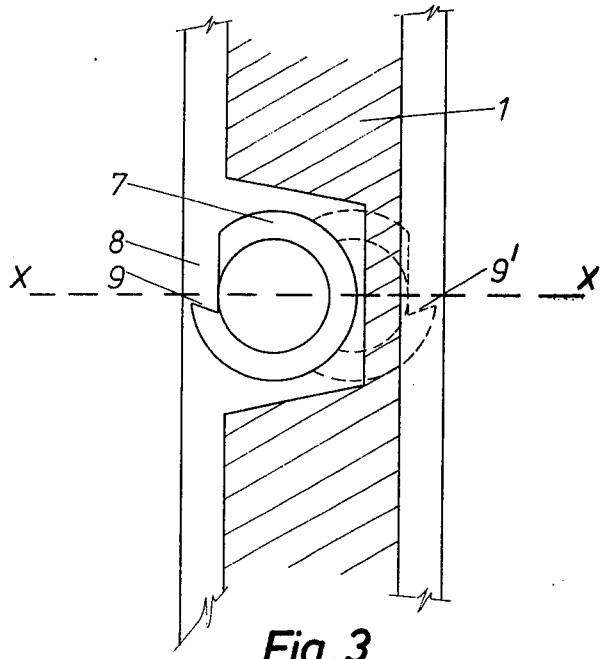
FIG. 3 is a partial section through the rotary cutter of FIG. 1, taken along the line B—B.

Referring first to FIGS. 1 to 3, the rotary cutter comprises a body 1 having a central axial bore 2 enabling it to be mounted on a rotary shaft. Four cutter units 3 are mounted around the rotary cutter, with equal spacings, although only one is shown in FIG. 1. The cutter units 3 are mounted in pairs, one pair on one side of the rotary cutter and one pair on the other side. Each cutter unit 3 is displaced 90° from the adjacent units. Each cutter unit 3 comprises a frame 4 adapted to be bolted on the rotary cutter by means of bolts 5. A threaded shaft 6 passing through a boss 6a rotatable in each frame 4 mounts and locates a helical tooth profile 7. Rotation of the boss 6a enables the tooth profile 7 on the shaft 6 to be adjusted radially of the cutter unit 3 so as to maintain the line of cut constant.

Each tooth profile 7 has a 17° bevel formed on both sides around its periphery, tapering to a 0.01 inch flat at its apex. The flat at the base of the tooth profile is of a width equal to half the pitch of the profile. A continuous recess 8 as shown in FIG. 3 is ground along the length of the tooth profile in each unit 3, to form a series of cutter teeth 9. The diametrically opposite cutter units 3 of each pair are mounted at radial spacings differing by one half pitch of the tooth profile 7 so that in use together they cut a continuous series of equally spaced grooves in the timber. Similarly the adjacent cutter units 3, which are disposed on opposite sides of the body 1, are mounted at radial spacings differing by one quarter pitch of the tooth profile 7, so that in use the grooves cut in one piece of timber are aligned with the fingers remaining between grooves in the other piece of timber.

FIGS. 1 and 2 show at 7′ the relative location of the cutter teeth of the cutter unit mounted on the same side of the rotary cutter 1, and FIG. 3 shows at 9′ the relative location of the cutter teeth of the cutter unit mounted on the other side of the rotary cutter 1.

Figure 9:
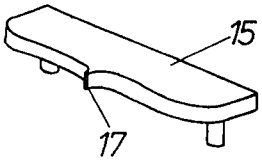
FIG. 9 is a perspective view of a gauge to be used in conjunction with the cutter of FIG. 1.

Each unit 3 is mounted so that the teeth 9 project from the body 1 is one side or the other pointing in the appropriate direction of cut. The desired radial dispositions of the cutter units can readily be obtained by rotation of the boss 6a. A gauge 15 such as that illustrated in FIG. 9 and shown in broken lines in FIG. 1 can be mounted in bores 16 in the body 1, and the boss 6a adjusted until one tooth 9 is directly adjacent a central nib 17 of the gauge. By spacing adjacent pairs of bores 16 one quarter pitch radially apart, this readily achieves the desired setting. The cutter units are clamped at their radially outer ends when setting is complete.

Around the edge of the rotary cutter 1 are mounted peripheral saw teeth 10 which are intended to square the end of a piece of timber as the rotary cutter 1 is moved laterally across the timber. One such ring of saw teeth 1 is arranged on each side of the rotary cutter 1, as shown in FIG. 2. Between the two rings of saw teeth 10 are mounted a number of hogger blades 11 (FIGS. 4 and 5) for removing any excess timber which is of greater width than the width of each individual saw tooth 10.

In use, two pieces of timber are arranged with their ends facing one another and the rotary cutter 1 is moved transversely across both pieces, so that the saw teeth 10 cut cleanly across the end grain and provide square ends to the pieces of timber. With the pieces of timber in the position indicated at 12 in FIG. 1, the rotary cutter is able to produce the arcuate grooves in the end grain. This is achieved by advancing the timber relative to the rotary cutter until the teeth 9 and 9′ cut cooperating arcuate grooves in the ends of the two pieces of timber. The timber is then withdrawn relative to the rotary cutter 1, preferably to a slightly wider spacing than the width of the cutter 1, the rotary cutter moved bodily away from the timber, adhesive to the ends of the timber and the ends pressed firmly together.

To resharpen the cutter teeth 9 and 9′ in the cutter units 3, all that is necessary is to extend the continuous slot 8 through all the discs 7 by grinding, rotate the helical tooth profile 7 on the shaft 6 until the cutter teeth 9 or 9′ again extend just short of the central plane X—X of the cutter block as shown in FIG. 3, and re-set the cutter units 3 radially by means of the gauge 15, followed by re-clamping the profile 7.

Figure 4:
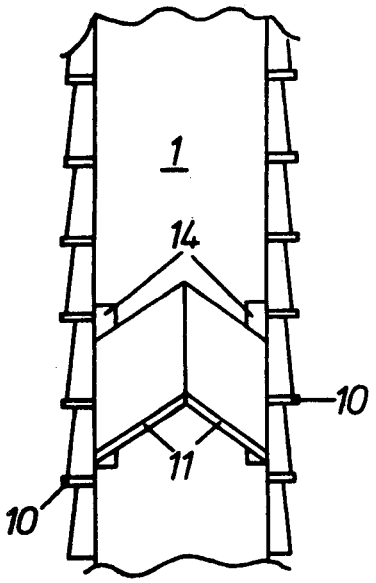
FIG. 4 is a plan view of the hogger teeth of the rotary cutter of FIG. 1 in the zone indicated C.
Figure 5:
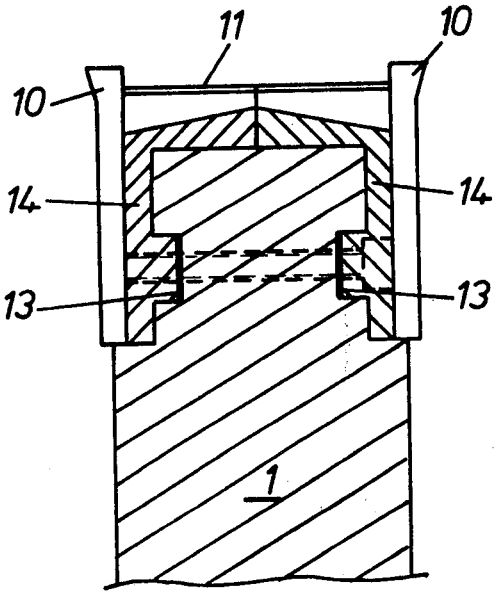
FIG. 5 is a section through the peripheral saw teeth of the rotary cutter of FIG. 4 in the zone indicated C, the section being taken along the line E—E.

FIGS. 4 and 5 show the positioning of hogger teeth 11, which remove any unwanted timber between the two circles of cutter teeth 10. The hogger teeth 11 are mounted on plate 14 which fit into recesses 13, and are bolted to, the sides of the body 1.

Figure 6:
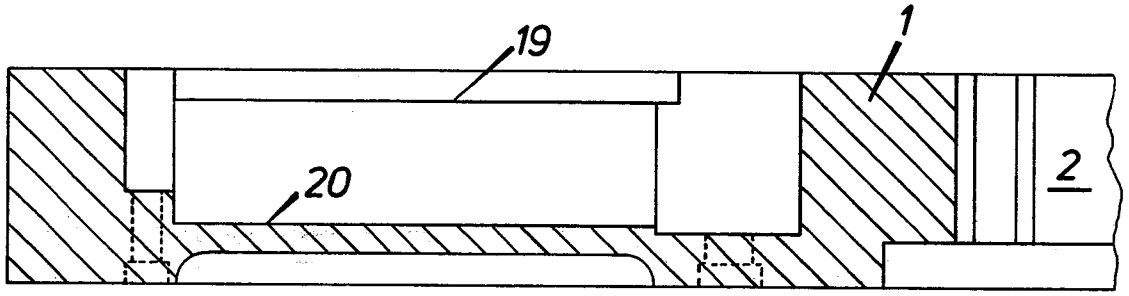
FIG. 6 is a section through the body, taken along the line F—F of FIG. 1.

FIG. 1 also shows details of the body 1. Recesses 20 are formed in the body 1 for receiving the cutter units 3. FIG. 6 shows the actual shape of each recess 20, the sides of which are chamfered at 19 to avoid clogging in use.

Figure 7:
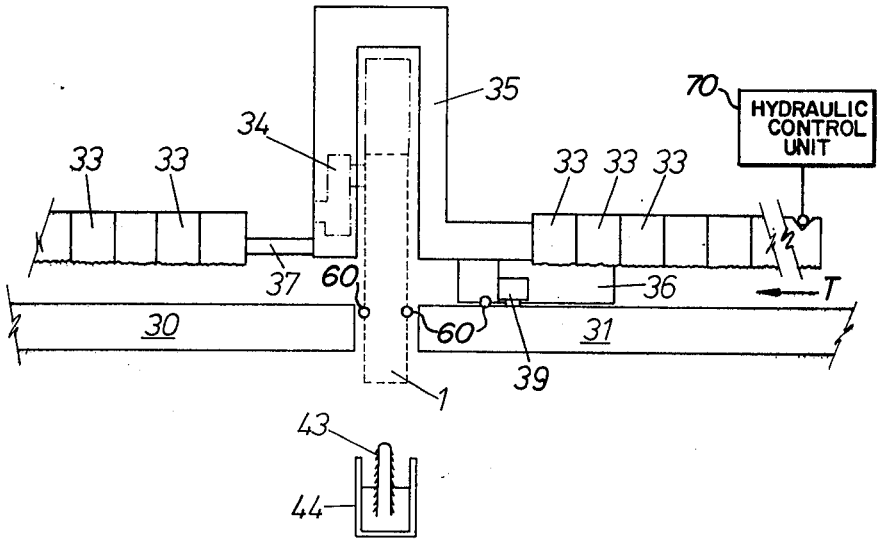
FIG. 7 is a schematic side elevation of a work station of a woodworking machine embodying a cutter according to the invention.
Figure 8:
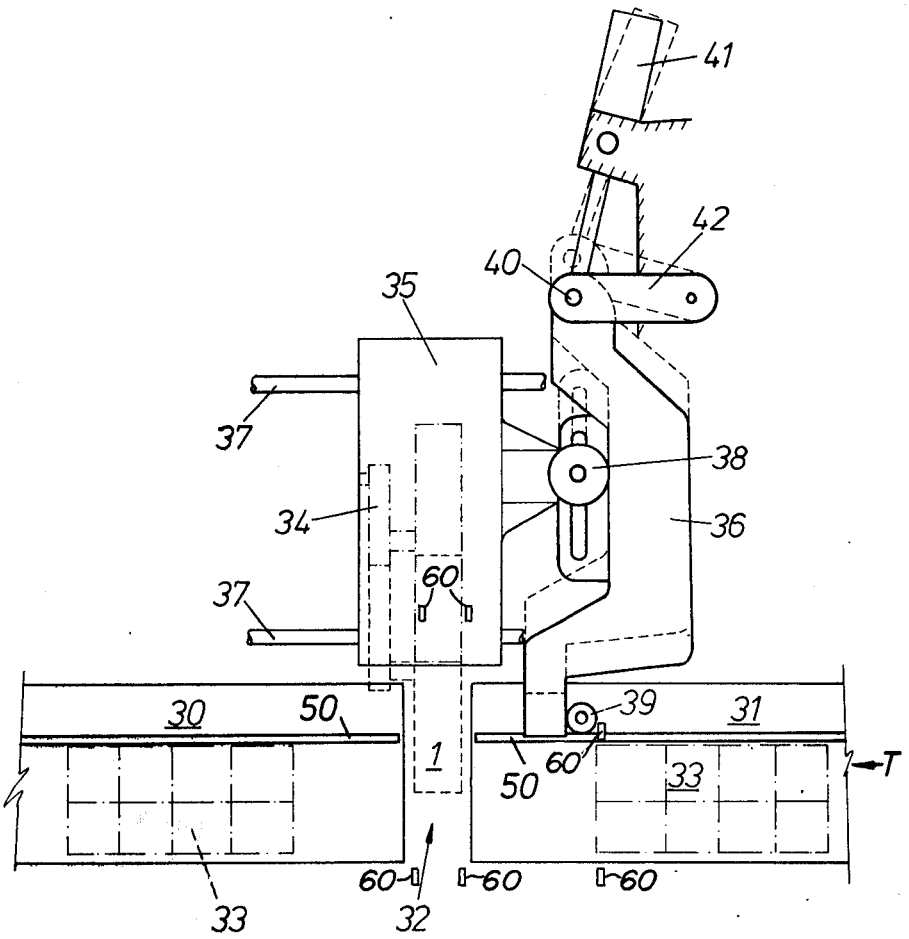
FIG. 8 is a schematic plan view of the work station of the machine of FIG. 7.

Referring to FIGS. 7 and 8, work tables 30 and 31 are provided for the two pieces of timber to be joined. Timber is automatically fed in the direction of the arrow T, and a first piece is allowed to pass a work station 32 until its tail end is just in the cutting line of the left hand side of the cutter 1. A second piece of timber is fed until its leading edge is just in the cutting line of the right hand edge of the rotary cutter 1, and both pieces are clamped lightly against a side fence 50 by pneumatic clamps (not shown) and then clamped securely to the work tables by means of hydraulically operated clamps 33. Over each work table a number of independently operable clamps 33 is provided, in two banks, to compensate for variations in the thickness of the timber. The hydraulic controls for the clamps 33 are indicated schematically in FIG. 7 by hydraulic drive unit 70.

The cutter 1, which is at the end of a swing arm 34 in a housing 35 and is driven by a motor (not shown), is then advanced by means of a hydraulic ram (not shown). The peripheral saw teeth 10 on the rotary cutter 1 thus trim the ends of the timber to form smooth square ends. When the rotary cutter 1 has advanced to its full depth (shown in dotted lines in FIG. 8), it has a position relative to the timber as shown in FIG. 1. At this stage the rotary cutter 1 is maintained in the advanced position and is still rotating while the work table 31 is moved for a predetermined distance in the direction of the arrow T. This causes movement of a lever 36 which moves the entire housing 35, including the rotary cutter 1, in the same direction. This movement is facilitated by mounting the housing 35 on a slide way 37. Because the point of contact between the lever 36 and a roller 38 on the housing 35 is midway between its pivotal axis 40 and its point of contact with a roller 39 on the table 31, the lever 36 moves the rotary cutter 1 exactly half the distance of movement of the table 31. Thus the rotary cutter 1 cuts arcuate grooves to equal depths in both end faces of the timber. The table 31 is then retracted, and the arm 34 swung to move the rotary cutter 1 clear of the timber. At this stage the lever 36 is moved by a pneumatic ram 41 acting on an arm 42, to a position in which it is no longer actuated by table movement, this position being shown in dotted lines in FIG. 8, and paddles 43 are raised from a glue bath 44 to apply glue to the facing grooved end surfaces of timber. After withdrawal of the paddles 43, the table 31 and the second piece of timber are again advanced in the direction of the arrow T until it is pressed firmly against the first piece of timber on the table 30, the joint pressure being controlled by hydraulic rams. At this stage the joint is complete but for the setting of the adhesive, and the joined pieces of timber are removed in the direction of the arrow T. When the trailing end of the second piece of timber reaches the rotary cutter 1, the timber can again be arrested and a further piece joined in the same way so as to build up continuous lengths.

The operation of the above apparatus is completely automatic, being controlled in known manner by sensors 60 for determining the precise position of each piece of timber at any given time. The sensors 60 are preferably photoelectric sensors and are advantageously connected to operate feed rollers which advance the pieces of timber in the direction of the arrow T. If desired a sequence of photoelectric sensors may be utilized in known manner for identifying when an edge of timber is approaching and is at a work station. The first sensors of such a sequence slow down the feed rollers as the timber end approaches the work station so that the timber can be stopped in a precise manner by the last sensors of the sequence without overshooting the work station.

I claim:

1. A method of joining pieces of timber end-to-end to form a continuous length, which comprises the following consecutive steps:

positioning two pieces of timber in end-to-end relationship;

moving a rotating cutter disc from a rest position transversely across the timber so that peripheral saw teeth on the cutter disc square the facing ends of the pieces of timber;

effecting relative movement between each piece of timber and the rotating cutter disc so as to bring the facing ends of the pieces of timber into contact with cutter teeth on opposite side faces of the cutter disc to cut arcuate grooves in the timber, adjacent grooves on each piece of timber being separated by arcuate fingers and the fingers on one piece of timber being aligned with the grooves on the other piece;

effecting relative movement between each piece of timber and the rotating cutter disc so as to remove the timber from the path of the cutter teeth;

removing the cutter disc transversely back to said rest position;

applying adhesive to the facing grooved ends of the timber and pushing the facing grooved ends of timber together so that the fingers of each piece are received in the grooves of the other piece.

2. A method according to claim 1, wherein the initial positioning of the pieces of timber in end-to-end relationship is effected by advancing the pieces of timber serially in the same direction and clamping the leading piece in position when its trailing edge is just within the cutting path of the peripheral saw teeth, and clamping the following piece in position when its leading edge is just within the cutting path of the peripheral saw teeth.

3. A method according to claim 2, wherein the timber is positioned automatically in response to photoelectric sensors.

4. A method according to claim 2, wherein the two pieces of timber are initially positioned in end-to-end relation on a worktable and the following piece of timber is clamped to the worktable which is moved to effect relative movement between the timber and the rotating cutter.

5. A method according to claim 4, wherein the worktable is moved a predetermined distance towards the rotating cutter and the rotating cutter is moved axially for half the predetermined distance towards the leading piece of timber to bring the facing ends of the timber into contact with the cutter teeth.

6. A woodworking machine for joining pieces of timber end-to-end, comprising:

a rotary cutter block located at a work station of the machine and mounted so as to be rotatable about a rotational axis parallel to the longitudinal direction of movement of the timber and movable transversely to said rotational axis;

cutter teeth mounted on said cutter block and extending from opposite side faces of the cutter block;

means for advancing pieces of timber in said longitudinal direction of movement serially past the work station;

means for arresting the timber end-to-end on opposite sides of the work station;

means for introducing the rotary cutter block between the pieces of timber;

means for effecting relative movement between the timber and the cutter block transversely to said rotational axis so that said cutter teeth cut arcuate grooves in the facing end faces of the timber;

means for withdrawing the cutter block;

means for applying adhesive to the grooved end faces; and means for moving the pieces of timber in said longitudinal direction of movement into contact with one another to form the joint with the arcuate grooves in each piece receiving arcuate fingers separating adjacent grooves in the other piece.

7. A machine according to claim 6, wherein the rotary cutter has peripheral saw teeth for squaring the ends of the timber as it is introduced between the pieces of timber at the work station.

8. A machine according to claim 7, wherein the rotary cutter has peripheral hogger teeth for removing waste wood at the work station as the ends are squared.

* * * * *